US008436540B2

(12) United States Patent
Cheng et al.

(10) Patent No.: US 8,436,540 B2
(45) Date of Patent: May 7, 2013

(54) MULTI-LAMP DRIVING SYSTEM

(75) Inventors: Chin-Po Cheng, Jhongli (TW); Yong-Long Lee, Jhongli (TW)

(73) Assignee: Ampower Technology Co., Ltd., Jhongli, Taoyuan County (TW)

( * ) Notice: Subject to any disclaimer, the term of this patent is extended or adjusted under 35 U.S.C. 154(b) by 214 days.

(21) Appl. No.: 13/110,006

(22) Filed: May 18, 2011

(65) Prior Publication Data

US 2012/0235571 A1 Sep. 20, 2012

(30) Foreign Application Priority Data

Mar. 15, 2011 (CN) ..... 2011 1 0062586

(51) Int. Cl.
*H05B 37/02* (2006.01)

(52) U.S. Cl.
USPC ..... 315/130; 315/219

(58) Field of Classification Search ..... None
See application file for complete search history.

(56) References Cited

U.S. PATENT DOCUMENTS 5,872,429 A * 2/1999 Xia et al. ..... 315/194
2009/0195168 A1* 8/2009 Greenfeld ..... 315/192

* cited by examiner

*Primary Examiner* — Crystal L Hammond
(74) *Attorney, Agent, or Firm* — Altis Law Group, Inc.

(57) ABSTRACT

A multi-lamp driving system includes a pulse width modulation (PWM) controller, transformers, a current difference detection circuit, a lighting detection circuit, a frequency scanning detection circuit, a frequency regulating circuit, and a duty cycle regulating circuit. The current difference detection circuit detects difference among current flowing through lamps to determine if the current fluctuates. The lighting detection circuit determines if the lamps are lit according to the current, and generates a lighting indication signal after the lamps are lit. The frequency scanning detection circuit determines if the multi-lamp driving system is in a frequency scanning process according to the lighting indication signal, and generates a frequency scanning indication signal if the multi-lamp driving system is in the frequency scanning process. The duty cycle regulating circuit regulates duty cycles of the PWM signals upon the condition that the current fluctuates and the multi-lamp driving system is in the frequency scanning process.

14 Claims, 6 Drawing Sheets

MULTI-LAMP DRIVING SYSTEM

BACKGROUND

1. Technical Field

The disclosure relates to backlight driving systems, and particularly to a multi-lamp driving system.

2. Description of Related Art

Cold cathode fluorescent lamps (CCFL) are usually used for a backlight of a liquid crystal display. An inverter converts direct current power into alternating current power to provide proper driving power to light the CCFLs. The inverter usually utilizes a single sided printed circuit board without a high voltage capacitor in order to reduce costs. In this structure, the inverter does not have voltage feedback. In order to solve the above problem, the inverter first uses frequency hopping and soft starting, and then uses a fixed duty cycle driving mode to light the CCFLs.

The inverter using the fixed duty cycle driving mode uses a decreased duty cycle because of concern of tolerance voltage of transformers and lighting voltage. In poor environment, such as, environments with low temperature, low lamp current, or darkroom, lamp current fluctuates when the CCFLs are driven by the inverter, which results in the CCFLs flickering, mis-acting to protect, or the CCFLs lighting failure.

DETAILED DESCRIPTION

Figure 1:
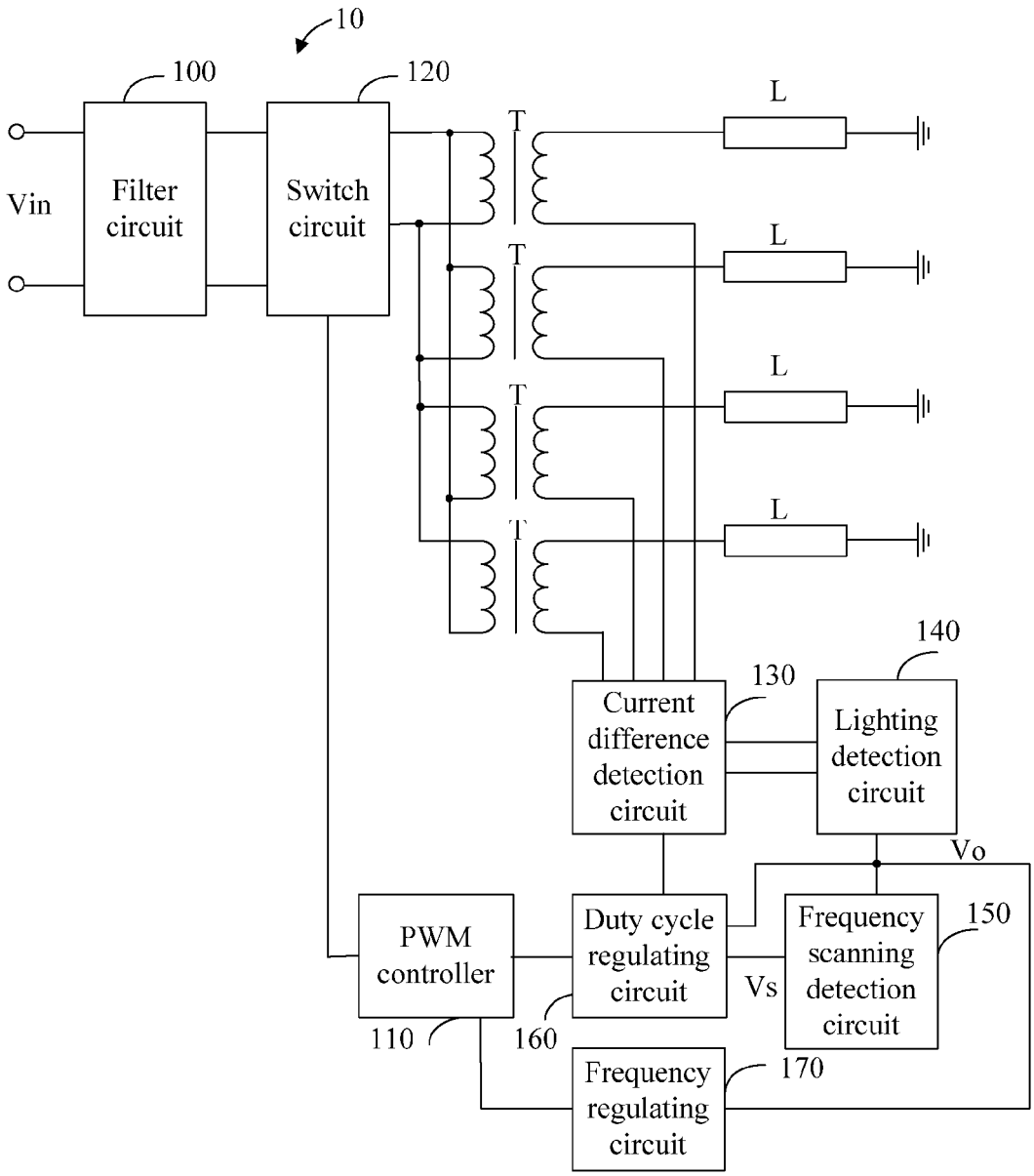
FIG. 1 is a schematic diagram of one embodiment of a multi-lamp driving system as disclosed.

FIG. 1 is a schematic diagram of one embodiment of a multi-lamp driving system 10 as disclosed. In one embodiment, the multi-lamp driving system 10 converts an input power supply Vin into alternating current (AC) power to drive a plurality of lamps L (only four shown). The input power supply Vin is a direct current (DC) power supply. In alternative embodiments, the input power supply Vin may be an AC power supply, and the multi-lamp driving system 10 may further include a rectifier circuit connected between the input power supply Vin and the filter circuit 100. The multi-lamp driving system 10 includes a filter circuit 100, a switch circuit 120, a pulse width modulation (PWM) controller 110, a plurality of transformers T (only four shown), a current difference detection circuit 130, a lighting detection circuit 140, a frequency scanning detection circuit 150, a duty cycle regulating circuit 160, and a frequency regulating circuit 170. The filter circuit 100 filters input power signals of the input power supply Vin, and includes capacitors, such as, three capacitors in parallel. The filter circuit 100 outputs DC power signals to the switch circuit 120 after filtering the input power signals.

The switch circuit 120 converts the DC power signals from the filter circuit 100 into first AC power signals. In one embodiment, the first AC power signals are square wave signals. The switch circuit 120 may be one of a full bridge circuit, a half bridge circuit, a push-pull circuit, and other related circuits. The PWM controller 110 controls output of the switch circuit 120. The PWM controller 110 generates PWM signals to control on-off of the switch circuit 120, thus, the switch circuit 120 converts the DC power signals from the filter circuit 100 into the first AC power signals.

Each of the plurality of transformers T includes a primary winding and a secondary winding. The primary windings of the plurality of transformers T are connected to the switch circuit 120 in parallel, and high voltage terminals of the secondary windings of the plurality of transformers T are connected to the plurality of lamps L, respectively. That is, the high voltage terminal of the secondary winding of the first transformer T is connected to the first lamp L, and the high voltage terminal of the secondary winding of the second transformer T is connected to the second lamp L, and so on. The plurality of transformers T convert the first AC power signals from the switch circuit 120 into second AC power signals. In one embodiment, the second AC power signals are sine wave signals. In one embodiment, positive voltage inputs of the primary windings of the first and the second transformers T are connected to a positive voltage output of the switch circuit 120, and positive voltage inputs of the primary windings of the third and the fourth transformers T are connected to a negative voltage output of the switch circuit 120. Thus, the positive voltage inputs of the primary windings of the first and the second transformers T have opposite phases to the positive voltage inputs of the primary windings of the third and the fourth transformers T.

The current difference detection circuit 130 is connected to the secondary windings of the plurality of transformers T, and detects difference among current flowing through the plurality of lamps L to determine if the current flowing through the plurality of lamps L fluctuates. In a normal condition, the current flowing through the plurality of lamps L is nearly the same. If there is a big difference among the current flowing through the plurality of lamps L, it indicates that the current flowing through the plurality of lamps L fluctuates. In this embodiment, the current difference detection circuit 130 determines if the difference among the current flowing through the plurality of lamps L exceeds a first predetermined value, to determine if the current flowing through the plurality of lamps L fluctuates. If the difference among the current flowing through the plurality of lamps L exceeds the first predetermined value, the current difference detection circuit 130 determines the current flowing through the plurality of lamps L fluctuates. If the difference among the current flowing through the plurality of lamps L does not exceed the first predetermined value, the current difference detection circuit 130 determines the current flowing through the plurality of lamps L does not fluctuate.

The lighting detection circuit 140 is connected to the current difference detection circuit 130, and determines if the plurality of lamps L are lit according to the current flowing through the plurality of lamps L and generates a lighting indication signal Vo after the plurality of lamps L are lit. In one embodiment, if the current flowing through the plurality of lamps L are greater than a second predetermined value, which indicates the plurality of lamps L are lit, the lighting detection circuit 140 generates the lighting indication signal Vo.

The frequency regulating circuit 170 is connected to the lighting detection circuit 140 and the PWM controller 110, and regulates frequency of the PWM signals generated by the PWM controller 110 according to the lighting indication signal Vo. When the plurality of lamps L are lit, the frequency regulating circuit 170 regulates the frequency of the PWM signals low, and if the plurality of lamps L are being lit, the frequency regulating circuit 170 regulates the frequency of the PWM signals high.

The frequency scanning detection circuit 150 is connected to the lighting detection circuit 140, and determines if the multi-lamp driving system 10 is in a frequency scanning process according to the lighting indication signal Vo. The frequency scanning detection circuit 150 further generates a frequency scanning indication signal Vs if the multi-lamp driving system 10 is in the frequency scanning process. In one embodiment, when the multi-lamp driving system 10 is in a lighting transient, and the frequency of the PWM signals changes from high to low, the multi-lamp driving system 10 is in the frequency scanning process. Because the lighting indication signal Vo indicates if the plurality of lamps L are lit, the frequency scanning detection circuit 150 determines if the multi-lamp driving system 10 is in the frequency scanning process according to voltage level of the lighting detection circuit 140

The duty cycle regulating circuit 160 is connected to the current difference detection circuit 130, the lighting detection circuit 140, and the frequency scanning detection circuit 150, and regulates duty cycles of the PWM signals generated by the PWM controller 110 upon the condition that the current flowing through the plurality of lamps L fluctuates ad the multi-lamp driving system 10 is in the frequency scanning process.

Figure 2:
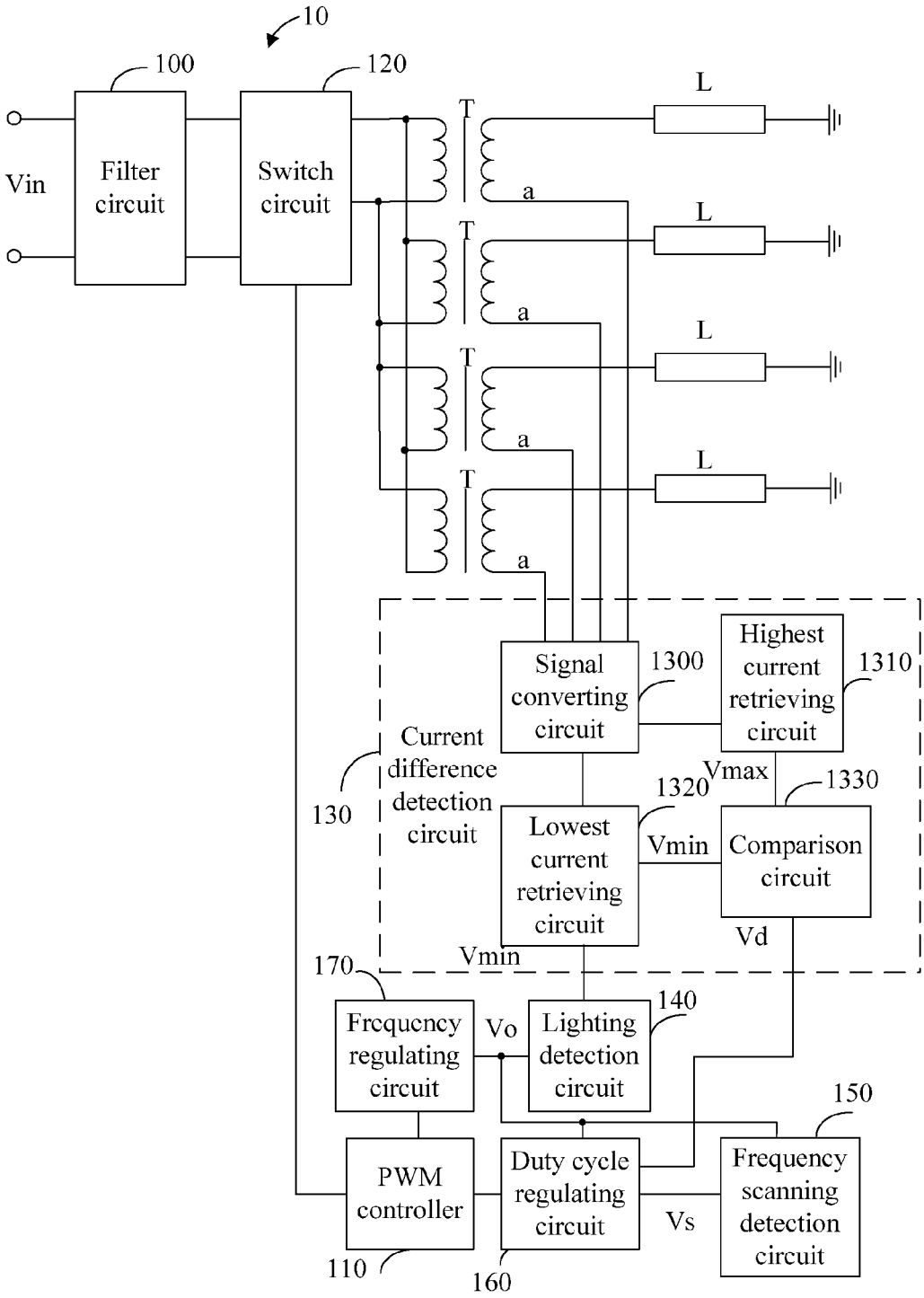
FIG. 2 is a circuit diagram of another embodiment of a multi-lamp driving system as disclosed.

FIG. 2 is a schematic diagram of another embodiment of the multi-lamp driving system 10. In one embodiment, the current difference detection circuit 130 includes a signal converting circuit 1300, a highest current retrieving circuit 1310, a lowest current retrieving circuit 1320, and a comparison circuit 1330. The signal converting circuit 1300 is connected to low voltage terminals a of the secondary windings of the plurality of transformers T, and converts current signals flowing through the plurality of lamps L into voltage signals. The highest current retrieving circuit 1310 is connected to the signal converting circuit 1300, and retrieves a highest voltage signal Vmax from the voltage signals corresponding to a highest current signal flowing through the plurality of lamps L. The lowest current retrieving circuit 1320 is connected to the signal converting circuit 1300, and retrieves a lowest voltage signal Vmin corresponding to a lowest current signal flowing through the plurality of lamps L.

The comparison circuit 1330 is connected to the highest current retrieving circuit 1310 and the lowest current retrieving circuit 1320, and determines if difference between the highest voltage signal Vmax and the lowest voltage signal Vmin exceeds the first predetermined value. If the difference between the highest voltage signal Vmax and the lowest voltage signal Vmin exceeds the first predetermined value, the comparison circuit 1330 generates a current fluctuating indication signal Vd, which indicates the current flowing through the plurality of lamps L fluctuates. In one embodiment, the first predetermined value can be set according to actual needs, such as, to be 0.7V. The multi-lamp driving system 10 dynamically retrieves the highest current signal and the lowest current signal to compare to determine if there is abnormity, replacing with comparison with a fixed reference voltage. Thus, when environment temperature and parameters of the plurality of lamps L change, the highest current signal and the lowest current signal change correspondingly, which avoids mis-determination and misact.

The lighting detection circuit 140 is connected to the lowest current retrieving circuit 1320, and generates the lighting indication signal Vo when the lowest voltage signal Vmin exceeds the second predetermined value. The duty cycle regulating circuit 160 regulates the duty cycles of the PWM signals higher when receiving the current fluctuating indication signal Vd and the frequency scanning indication signal Vs at the same time. The duty cycle regulating circuit 160 regulates the duty cycle of the PWM signal lower when not receiving the current fluctuating indication signal Vd and the frequency scanning indication signal Vs at the same time. In one embodiment, the second predetermined value can also be set according to actual needs, such as, to be 0.7V.

Figure 3:
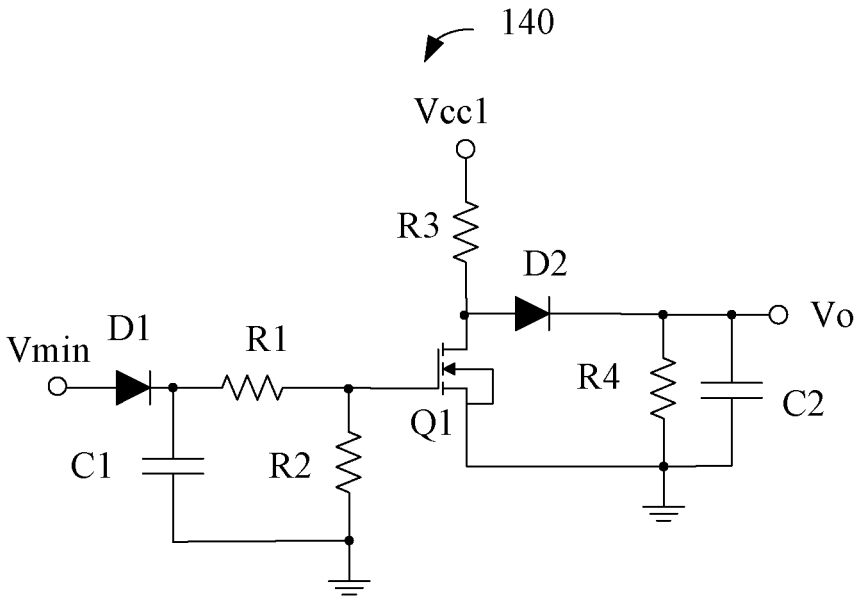
FIG. 3 is a circuit diagram of one embodiment of a lighting detection circuit of a multi-lamp driving system as disclosed.

FIG. 3 is a circuit diagram of one embodiment of the lighting detection circuit 140. In one embodiment, the lighting detection circuit 140 includes a first switch Q1 including a control pole, a first pole, and a second pole, a first diode D1, a second diode D2, a first capacitor C1, a second capacitor C2, and first to fourth resistors R1 to R4. An anode of the first diode D1 receives the lowest voltage signal Vmin, and a cathode of the first diode D1 is grounded via the first capacitor C1. The first resistor R1 is connected between the cathode of the first diode D1 and the control pole of the first switch Q1. The second resistor R2 is connected between the control pole of the first switch Q1 and the ground. The first pole of the first switch Q1 is connected to a first reference power supply Vcc1 via the third resistor R3, and the second pole of the first switch Q1 is grounded.

An anode of the second diode D2 is connected to the first pole of the first switch Q1, and a cathode of the second diode D2 acts as an output of the lighting detection circuit 140 to output the lighting indication signal Vo. The fourth resistor R4 is connected between the cathode of the second diode D2 and the ground, and the second capacitor C2 is connected to the fourth resistor R4 in parallel. In one embodiment, the second diode D2 is used to rectify to output DC signals, that is, the lighting indication signal Vo is a DC signal. The fourth resistor R4 and the second capacitor C2 is used to charge and discharge.

In this embodiment, the multi-lamp driving system 10 just lights the plurality of lamps L, the current flowing through the plurality of lamps L is low at this time. After the plurality of lamps L are lit, the current flowing through the plurality of lamps L increases. Therefore, the lighting detection circuit 140 determines if the plurality of lamps L are lit according to if the lowest current flowing through the plurality of lamps L exceeds the second predetermined value.

In one embodiment, the first switch Q1 is a N-type metal oxide semiconductor field effect transistor (NMOSFET), the control pole is a gate of the NMOSFET, the first pole is a drain of the NMOSFET, and the second pole is a source of the NMOSFET.

Figure 4:
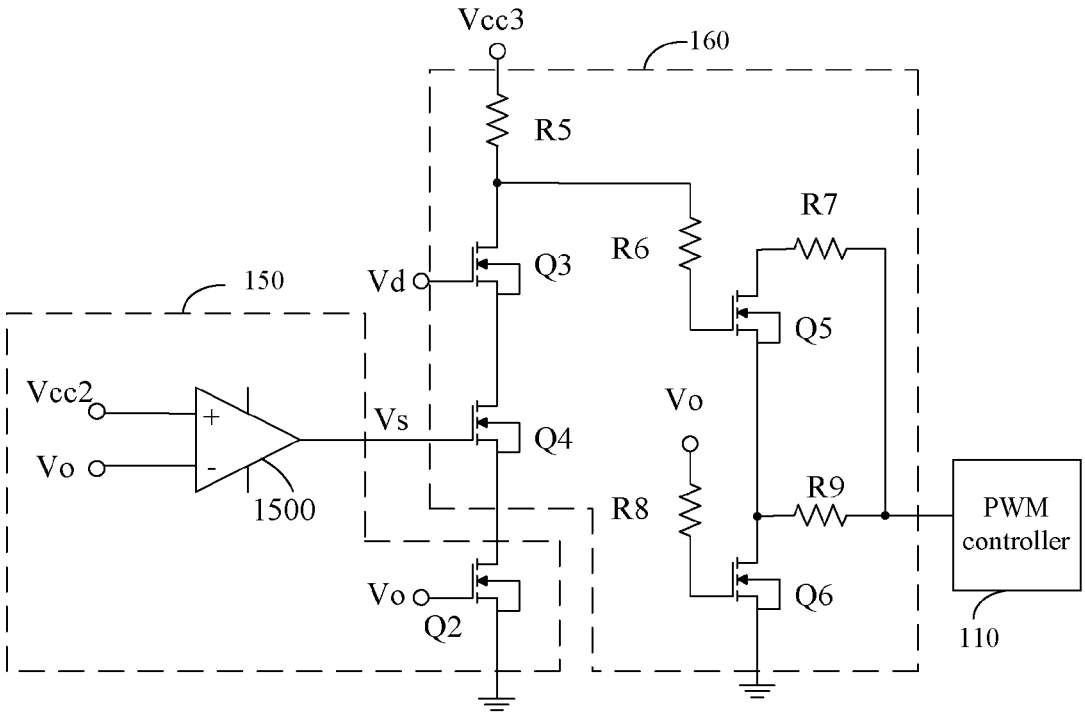
FIG. 4 are circuit diagrams of one embodiment of a frequency scanning detection circuit and a duty cycle regulating circuit of a multi-lamp driving system as disclosed.

FIG. 4 is a circuit diagram of the frequency scanning detection circuit 150 and the duty cycle regulating circuit 160. In one embodiment, the frequency scanning detection circuit 150 includes a comparator 1500 and a second switch Q2. The comparator 1500 includes a non-inverting input, an inverting input, and an output. The non-inverting input of the comparator 1500 is connected to a second reference power supply Vcc2, the inverting input of the comparator 1500 receives the lighting indication signal Vo, and the output outputs the frequency scanning indication signal Vs. The second switch Q2 includes a control pole, a first pole, and a second pole. The control pole of the second switch Q2 receives the lighting indication signal Vo, the first pole of the second switch Q2 is connected to the duty cycle regulating circuit 160, and the second pole of the second switch Q2 is grounded.

The comparator 1500 compares the lighting indication signal Vo with the second reference power supply Vcc2 as well as the second switch Q2 compares the lighting indication signal Vo with a threshold of the second switch Q2, to commonly determine if the multi-lamp driving system 10 is in the frequency scanning process. If the lighting indication signal Vo is less than the second reference power supply Vcc2 and greater than the threshold of the second switch Q2, the multi-lamp driving system 10 is in the frequency scanning process, and the frequency scanning detection circuit 150 generates the frequency scanning indication signal Vs.

The duty cycle regulating circuit 160 includes third to sixth switches Q3 to Q6 and fifth to ninth resistors R5 to R9. Each of the third to sixth switches Q3 to Q6 respectively includes a control pole, a first pole, and a second pole. The control pole of the third switch Q3 receives one of the current fluctuating indication signal Vd and the frequency scanning indication signal Vs, the first pole of the third switch Q3 is connected to a third reference power supply Vcc3 via the fifth resistor R5, and the second pole of the third switch Q3 is connected to the first pole of the fourth switch Q4. The control pole of the fourth switch Q4 receives the other one of the current fluctuating indication signal Vd and the frequency scanning indication signal Vs, and the second pole of the fourth switch Q4 is connected to the first pole of the second switch Q2 of the frequency scanning detection circuit 150.

The control pole of the fifth switch Q5 is connected to the first pole of third switch Q3 via the sixth resistor R6, the first pole of the fifth switch Q5 is connected to the PWM controller 110 via the seventh resistor R7, and the second pole of the fifth switch Q5 is connected to the first pole of the sixth switch Q6. The control pole of the sixth switch Q6 receives the lighting detection signal Vo via the eighth resistor R8, the first pole of the sixth switch Q6 is connected to the PWM controller 110 via the ninth resistor R9 commonly with the first pole of the fifth switch Q5 via the seventh resistor R7, and the second pole of the sixth switch Q6 is grounded. In this embodiment, the duty cycle regulating circuit 160 is connected to a cout pin of the PWM controller 110. That is, the first pole of the fifth switch Q5 and the first pole of the sixth switch Q6 are commonly connected to the cout pin of the PWM controller 110, respectively via the seventh resistor R7 and the ninth resistor R9.

In one embodiment, the second to the sixth switches Q2 to Q6 are N-type metal oxide semiconductor field effect transistors (NMOSFETs). The control poles of the second to the sixth switches Q2 to Q6 are gates of the NMOSFETs, the first poles of the second to the sixth switches Q2 to Q6 are drains of the NMOSFET, and the second poles of the second to the sixth switches Q2 to Q6 are sources of the NMOSFET. The current fluctuating indication signal Vd and the frequency scanning indication Vs are both high level signals.

Figure 5:
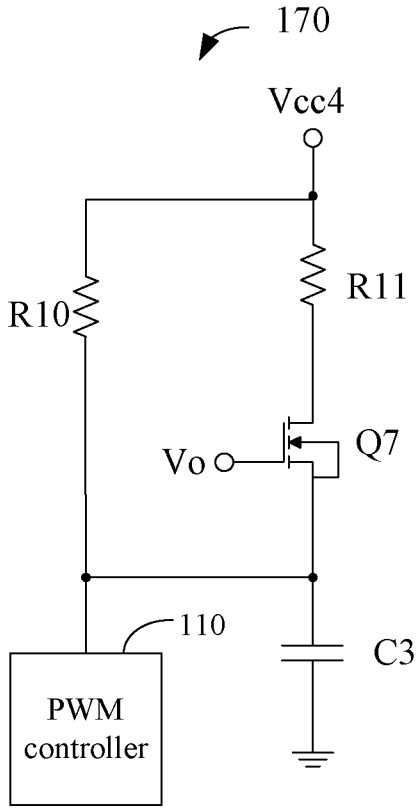
FIG. 5 is a circuit diagram of one embodiment of a frequency regulating circuit of a multi-lamp driving system as disclosed.

FIG. 5 is a circuit diagram of one embodiment of the frequency regulating circuit 170. In this embodiment, the frequency regulating circuit 170 includes a seventh switch Q7, a tenth resistor R10, an eleventh resistor R11, and a third capacitor C3. The tenth resistor R10 is connected between a fourth reference power supply Vcc4 and the PWM controller 110. The seventh switch Q7 includes a control pole, a first pole, and a second pole. The eleventh resistor R11 is connected between the fourth reference power supply Vcc4 and the first pole of the seventh switch Q7. The control pole of the seventh switch Q7 receives the lighting indication signal Vo, and the second pole of the seventh switch Q7 is grounded via the third capacitor C3 and connected to the PWM controller 110 commonly with the tenth resistor R10. In this embodiment, the frequency regulating circuit 170 is connected to a CT pin of the PWM controller 110. The seventh switch Q7 may be a N-type metal oxide semiconductor field effect transistor (NMOSFET), with the control pole being a gate of the NMOSFET, the first pole being a drain of the NMOSFET, and the second pole being a source of the NMOSFET.

Figure 6:
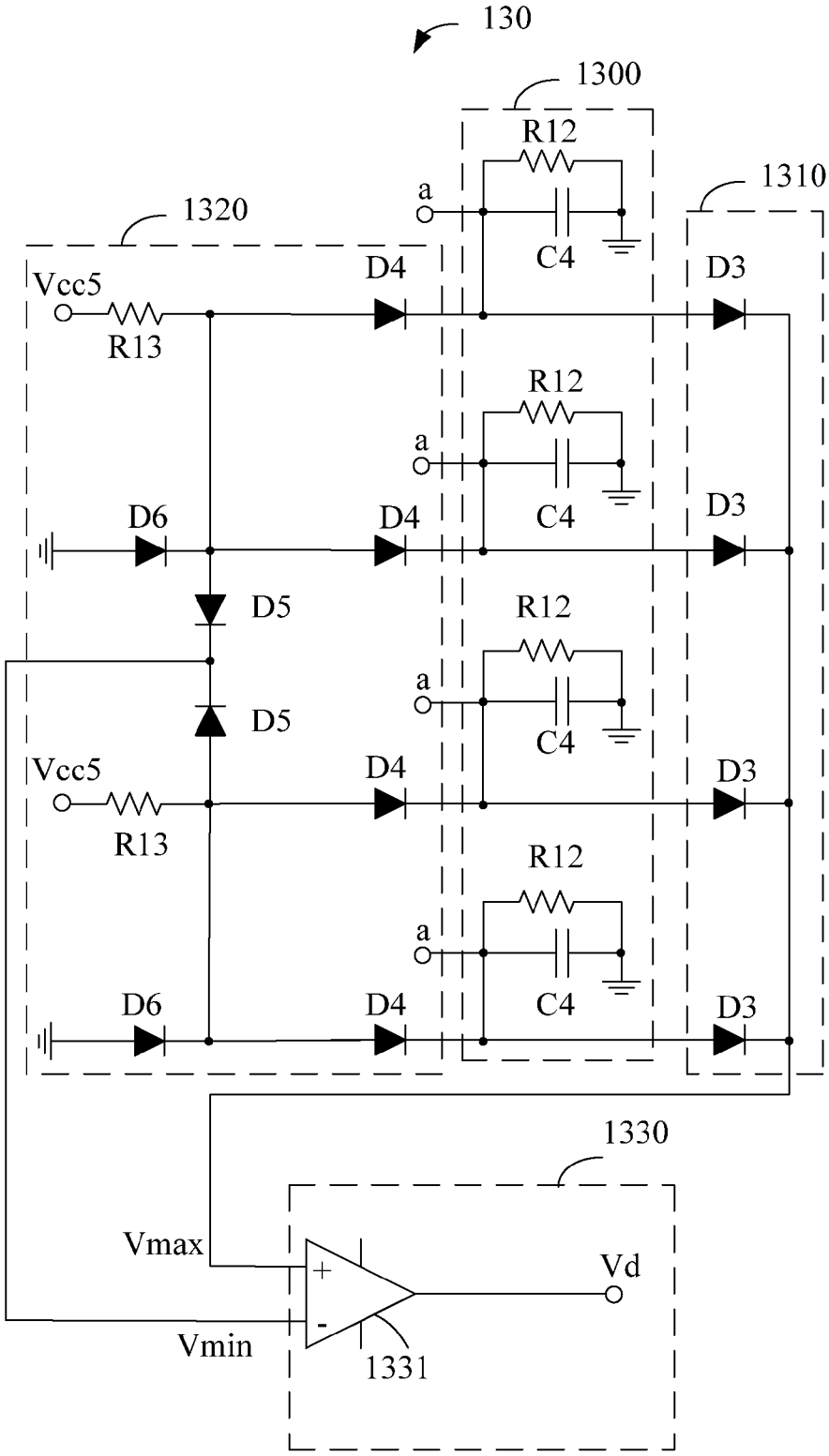
FIG. 6 is a circuit diagram of one embodiment of a current difference detection circuit of a multi-lamp driving system as disclosed.

FIG. 6 is a circuit diagram of one embodiment of the current difference detection circuit 130. In one embodiment, the signal converting circuit 1300 includes a plurality of signal converting units, and the plurality of signal converting units are correspondingly connected to the low voltage terminals a of the secondary windings of the plurality of transformers T. That is, a first signal converting unit is connected to the low voltage terminal a of the secondary winding of a first transformer T, and a second signal converting unit is connected to the low voltage terminal a of the secondary winding of a second transformer T, and so on. Each of the plurality of signal converting units converts the current signals flowing through corresponding lamps L into the voltage signals, and includes a twelfth resistor R12 and a fourth capacitor C4. The twelfth resistor R12 is connected between the low voltage terminal a of the secondary winding of the corresponding transformer T and the ground. The fourth capacitor C4 is connected to the twelfth resistor R12 in parallel. The twelfth resistor R12 converts the current signal flowing through the corresponding lamp L into the voltage signal, and the fourth capacitor C4 filters the voltage signal to retrieve a stable voltage signal. In one embodiment, the voltage signal may be an AC signal.

The highest current retrieving circuit 1310 includes a plurality of third diodes D3, and the plurality of third diodes D3 are correspondingly connected to the plurality of signal converting units and the low voltage terminals a of the secondary windings of the plurality of transformers T. Anodes of the plurality of third diodes D3 are correspondingly connected to the low voltage terminals a of the secondary windings of the plurality of transformers T, and cathodes of the plurality of third diodes D3 are connected together to output the highest voltage signal Vmax. The plurality of third diodes D3 selects the highest voltage signal Vmax from the voltage signals from the signal converting units, and outputs the highest voltage signal Vmax to the comparison circuit 1330.

Because the low voltage terminals a of the secondary windings of the plurality of transformers T have opposite phase, the lowest current retrieving circuit 1320 includes a plurality of fourth diodes D4, a plurality of fifth diodes D5, and a plurality of sixth diodes D6. For example, supposing that there are four lamps L and four transformers T and the low voltage terminals a of the secondary windings of the first and the second transformers T have opposite phase to the low voltage terminals a of the secondary windings of the third and the fourth transformers T, the lowest current retrieving circuit 1320 includes four fourth diodes D4, two fifth diodes D5, and two sixth diodes D6.

The plurality of fourth diodes D4 are correspondingly connected to the plurality of signal converting units and the low voltage terminals a of the secondary windings of the plurality of transformers T. Cathodes of the plurality of fourth diodes D4 are correspondingly connected to the low voltage terminals a of the secondary windings of the plurality of transformers T, and anodes of two of the plurality of fourth diodes D4 are connected together respectively. That is, the anodes of the first and the second fourth diodes D4 are connected together and connected to a first fifth reference power supply Vcc5 via a first thirteenth resistor R13, and the anodes of the third and the fourth diodes D4 are connected together and connected to a second fifth reference power supply Vcc5 via a second thirteenth resistor R13.

An anode of a first fifth diode D5 is connected to the anodes of the first and the second fourth diodes D4, an anode of a second fifth diode D5 is connected to the anodes of the third and the fourth diodes D4, and cathodes of the first and the second fifth diodes D5 are connected together to output the lowest voltage signal Vmin to the comparison circuit 1330. A cathode of a first sixth diode D6 is connected to the anode of the first fifth diode D5, and an anode of the first sixth diode D6 is grounded. A cathode of a second sixth diode D6 is connected to the anode of the second fifth diode D5, and an anode of the second sixth diode D6 is grounded. The sixth diodes D6 are used to convert negative voltage signals into positive voltage signals. In one embodiment, the highest voltage signal Vmax and the lowest voltage signal Vmin are both AC signals. In alternative embodiment, if the low voltage terminals a of the secondary windings of the plurality of transformers T have the same phases, the lowest current retrieving circuit 1320 only includes a plurality of fourth diodes D4 and one fifth diode D5, which has similar structures to that of the above, therefore, descriptions are omitted here.

The comparison circuit 1330 includes a comparator 1331 including an inverting input, a non-inverting input, and an output. The non-inverting input of the comparator 1331 receives the highest voltage signal Vmax, the inverting input of the comparator 1331 receives the lowest voltage signal Vmin, and the output of the comparator 1331 output the current fluctuating indication signal Vd. In this embodiment, the current fluctuating indication signal Vd is a DC signal. The inverting input, the non-inverting input, and the output of the comparator 1331 are connected to necessary resistors, which are omitted here for brevity. In one embodiment, the lighting detection circuit 140 can have the same structure to that of the comparison circuit 1330, and the comparison circuit 1330 can have the same structure to that of the lighting detection circuit 140 of FIG. 3.

When the multi-lamp driving system 10 is in the lighting transient, the current flowing through the plurality of lamps L are low, that is, the lowest voltage signal Vmin is low. Therefore, the first switch Q1 is off, and the lighting detection circuit 140 outputs a high level signal. Thus, voltage of the inverting input of the comparator 1500 of the frequency scanning circuit 150 is greater voltage of the non-input of the comparator 1500, which makes the comparator 1500 outputs a low level signal to the fourth switch Q4 of the duty cycle regulating circuit 160. Thus, the fourth switch Q4 is off, and the fifth and the sixth switches Q5 and Q6 are turned on. Therefore, the seventh resistor R7 and the ninth resistor R9 are connected in parallel, and the duty cycle of the PWM signal is low. At this time, the seventh switch Q7 of the frequency regulating circuit 170 is turned on, which means that the tenth resistor R10 and eleventh resistor R11 are connected in parallel. Therefore, the frequency of the PWM signal is high.

If the multi-lamp driving system 10 cannot drive the plurality of lamps L normally, there is high current flowing through the plurality of lamps L, but the current fluctuates. That is, there is great difference among the current flowing through the plurality of lamps L. Thus, there is great difference among the voltage signals converted by the signal converting units corresponding to the current flowing through the plurality of lamps L. Because the plurality of third diodes D3 have the same parameters and the cathodes of the plurality of third diodes D3 are connected together, the third diode D3 corresponding to the lamp L with the highest current is turned on. Thus, the plurality of third diodes D3 retrieves the highest voltage signal Vmax corresponding to the highest current, and outputs the highest voltage signal Vmax to the non-inverting input of the comparator 1331.

Because the plurality of fourth diodes D4 have the same parameters and the anodes of two of the plurality of fourth diodes D4 are connected together respectively, one of per two fourth diodes D4 corresponding to the lamp L with lower current is turned on. Thus, per two fourth diodes D4 retrieve the lower voltage signal corresponding to the lower current. That is, the first and second fourth diodes D4 retrieve the lower voltage signal corresponding to the lower current flowing through the first or the second lamp L, and the third and fourth diodes D4 retrieve the lower voltage signal corresponding to the lower current flowing through the third or the fourth lamp L. Similarly, the fifth resistors D5 compares the retrieved lower voltage signal to retrieve the lowest voltage signal Vmin corresponding to the lowest current flowing through the plurality of lamps L.

Because the highest voltage signal Vmax is greater than the lowest voltage signal Vmin, the comparator 1331 of the current difference detection circuit 130 outputs the current fluctuating indication signal Vo with the high level. Because the current flowing through the plurality of lamps L is higher than the second predetermined value, the first switch Q1 is turned on, resulting in the second diode D2 off. At this time, the second capacitor C2 discharges via the fourth resistor R4, so the lighting indication signal Vo drops off.

When the lighting indication signal Vo is lower than the voltage of the non-inverting input of the comparator 1500 of the frequency scanning circuit 150 and higher than the threshold of the second switch Q2, the multi-lamp driving system 10 may be in the frequency scanning process. Therefore, the frequency scanning detection circuit 150 determines if the multi-lamp driving system 10 is in the frequency scanning process according to the voltage of the lighting indication signal Vo, and output the frequency scanning indication signal Vs with the high level. At this time, although the lighting indication signal Vo drops off, the lighting indication signal Vo also turns on the second switch Q2 and the sixth switch Q6.

Because the frequency scanning indication signal Vs and the current fluctuating indication signal Vd are high level signal, the third switch Q3 and the fourth switch Q4 are turned on. Therefore, the fifth switch Q5 is turned off. The ninth resistor R9 is connected to the PWM controller 110 alone, which resulting in the higher duty cycle of the PWM signal. Thus, when the plurality of lamps L fluctuate, the duty cycle of the PWM signal is regulated higher to improve the current fluctuating.

The multi-lamp driving system 10 detects if the current flowing the plurality of lamps L fluctuates when being lit by the current difference detection circuit 130, and regulates the duty cycle of the PWM signal if the current fluctuates and the multi-lamp driving system 10 is in the frequency scanning process. Thus, due to the change of the duty cycle of the PWM signal, the current flowing through the plurality of lamps L is stable, which improves the condition that a screen flicks or cannot be driven normally when the plurality of lamps L are being driven and avoids misact.

The foregoing disclosure of various embodiments has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto and their equivalents.

What is claimed is:

1. A multi-lamp driving system, to drive a plurality of lamps, comprising a filter circuit, a switch circuit, a pulse width modulation (PWM) controller to control output of the switch circuit, and a plurality of transformers each with primary windings connected to the output of the switch circuit in parallel, wherein high voltage ends of secondary windings of the transformers are connected to lamps respectively, and the multi-lamp driving system further comprises:

a current difference detection circuit, connected to low voltage ends of the secondary windings of the plurality of transformers, to detect difference among current flowing through the plurality of lamps to determine if the current flowing through the plurality of lamps fluctuates;

a lighting detection circuit, connected to the current difference detection circuit, to determine if the plurality of lamps are lit according to the current flowing through the plurality of lamps and to generate a lighting indication signal after the plurality of lamps are lit;

a frequency regulating circuit, connected to the lighting detection circuit, to regulate frequency of PWM signals generated by the PWM controller according to the lighting indication signal;

a frequency scanning detection circuit, connected to the lighting detection circuit, to determine if the multi-lamp driving system is in a frequency scanning process according to the lighting indication signal and to generate a frequency scanning indication signal if the multi-lamp driving system is in the frequency scanning process; and a duty cycle regulating circuit, connected to the current difference detection circuit, the lighting detection circuit, and the frequency scanning detection circuit, to regulate duty cycles of the PWM signals generated by the PWM controller upon the condition that the current flowing through the plurality of lamps fluctuates and the multi-lamp driving system is in the frequency scanning process.

2. The multi-lamp driving system of claim 1, wherein the current difference detection circuit comprises:

a signal converting circuit, connected to low voltage terminals of the secondary windings of the plurality of transformers, to convert the current flowing through the plurality of lamps L into voltage signals;

a highest current retrieving circuit, connected to the signal converting circuit, to retrieve a highest voltage signal from the voltage signals corresponding to a highest current flowing through the plurality of lamps;

a lowest current retrieving circuit, connected to the signal converting circuit, to retrieve a lowest voltage signal from the voltage signals corresponding to a lowest current flowing through the plurality of lamps; and a comparison circuit, connected to the highest current retrieving circuit and the lowest current retrieving circuit, to determine if difference between the highest voltage signal and the lowest voltage signal exceeds a first predetermined value and to generate a current fluctuating indication signal upon the condition that the difference between the highest voltage signal and the lowest voltage signal exceeds the first predetermined value.

3. The multi-lamp driving system of claim 2, wherein the lighting detection circuit determines if the plurality of lamps are lit according to the lowest voltage signal, and generates the lighting indication signal if the lowest voltage signal exceeds a second predetermined value.

4. The multi-lamp driving system of claim 3, wherein the lighting detection circuit comprises:

a first diode, with an anode of the first diode receiving the lowest voltage signal;

a first capacitor, connected between a cathode of the first diode and the ground;

a first resistor, with one end connected to the cathode of the first diode;

a second resistor, connected between the other end of the first resistor and the ground;

a first switch, comprising a control pole, a first pole, and a second pole, wherein the control pole is connected to the other end of the first resistor, a first pole is connected to a first reference power supply via a third resistor, and the second pole is grounded;

a second diode, with an anode connected to the first pole of the first switch, and a cathode outputting the lighting indication signal;

a fourth resistor, connected between the cathode of the second diode and the ground; and a second capacitor, connected to the fourth resistor in parallel.

5. The multi-lamp driving system of claim 4, wherein the first switch is an N-type metal oxide semiconductor field effect transistor (NMOSFET), the control pole is a gate of the NMOSFET, a first pole is a drain of the NMOSFET, and the second is a source of the MOSFEWT.

6. The multi-lamp driving system of claim 4, wherein the second capacitor and the fourth resistor are configured to charge and discharge.

7. The multi-lamp driving system of claim 2, wherein the frequency scanning detection circuit comprises:

a comparator, comprising an inverting input, a non-inverting input, and an output, the non-inverting input connected to a second reference power supply, the inverting input receiving the lighting indication signal, and the output outputting the frequency scanning indication signal; and a second switch, comprising a control pole, a first pole, and a second pole, wherein the control pole of the second switch receives the lighting indication signal, the first pole of the second switch is connected to the duty cycle regulating circuit, and the second pole of the second switch is grounded.

8. The multi-lamp driving system of claim 7, wherein when the lighting indication signal is less than the second reference power supply and greater than a threshold of the second switch, the frequency scanning detection circuit determines that the multi-lamp driving system is in the frequency scanning process.

9. The multi-lamp driving system of claim 7, wherein the duty cycle regulating circuit regulates the duty cycles of the PWM signals higher when receiving the current fluctuating indication signal and the frequency scanning indication signal at the same time, and regulates the duty cycles of the PWM signals lower when not receiving the current fluctuating indication signal and the frequency scanning indication signal at the same time.

10. The multi-lamp driving system of claim 7, wherein the duty cycle regulating circuit comprises:

a third switch, comprising a control pole, a first pole, and a second pole, wherein the control pole of the third switch receives one of the current fluctuating indication signal and the frequency scanning indication signal, and the first pole of the third switch is connected to a third reference power supply via a fifth resistor;

a fourth switch, comprising a control pole, a first pole, and a second pole, wherein the control pole of the fourth switch receives the other one of the current fluctuating indication signal and the frequency scanning indication signal, the first pole of the fourth switch is connected to the second pole of the third switch, and the second pole of the fourth switch is connected to the first pole of the second switch of the frequency scanning detection circuit;

a fifth switch, comprising a control pole, a first pole, and a second pole, wherein the control pole of the fifth switch is connected to the first pole of the third switch via a sixth resistor, and the first pole of the fifth switch is connected to the PWM controller via a seventh resistor;

a sixth switch, comprising a control pole, a first pole, and a second pole, wherein the control pole of the sixth switch receives the lighting indication signal via an eighth resistor, the first pole of the sixth switch is connected to the second pole of the fifth switch and is connected to the PWM controller via a ninth resistor commonly with the first pole of the fifth switch via the seventh resistor, and the second pole of the sixth switch is grounded.

11. The multi-lamp driving system of claim 10, wherein the second to the sixth switches are N-type metal oxide semiconductor field effect transistors (NMOSFETs), the control poles of the second to the sixth switches are gates of the NMOSFETs, the first poles of the second to the sixth switches are drains of the NMOSFETs, and the second poles of the second to the sixth switches are sources of the NMOSFETs.

12. The multi-lamp driving system of claim 1, wherein the frequency regulating circuit comprises:

a tenth resistor, with one end connected to a fourth reference power supply and the other end connected to the PWM controller;

an eleventh resistor, with one end connected to the fourth reference power supply commonly with the tenth resistor;

a seventh switch, comprising a control pole, a first pole, and a second pole, wherein the control pole of the seventh switch receives the lighting indication signal, the first pole of the seventh switch is connected to the other end of the eleventh resistor, and the second pole of the seventh switch is connected to the other end of the tenth resistor; and a third capacitor, connected between the second pole of the seventh switch and the ground.

13. The multi-lamp driving system of claim 12, wherein the seventh switch is a N-type metal oxide semiconductor field effect transistor (NMOSFET), the control pole of the seventh switch is a gate of the NMOSFET, the first pole of the seventh switch is a drain of the NMOSFET, and the second pole of the seventh switch is a source of the NMOSFET.

14. The multi-lamp driving system of claim 12, wherein when the plurality of lamps are lit, the frequency regulating circuit regulates the frequency of the PWM signals low, and when the plurality of lamps are being lit, the frequency regulating circuit regulates the frequency of the PWM signals high.

* * * * *